US006817074B2

(12) United States Patent
Lalonde et al.

(10) Patent No.: US 6,817,074 B2
(45) Date of Patent: Nov. 16, 2004

(54) PIERCING AND RIVETING TOOL, RIVET, AND METHOD

(76) Inventors: Donald R. Lalonde, 425 W. Napal Ave., Mesa, AZ (US) 85210; John G. Koehler, 4411 E. Capistrano, Phoenix, AZ (US) 85044

( * ) Notice: Subject to any disclaimer, the term of this patent is extended or adjusted under 35 U.S.C. 154(b) by 181 days.

(21) Appl. No.: 10/196,880

(22) Filed: Jul. 16, 2002

(65) Prior Publication Data

US 2004/0010898 A1 Jan. 22, 2004

(51) Int. Cl.[7] ..... B21J 15/04
(52) U.S. Cl. ..... 29/243.521; 29/798
(58) Field of Search ..... 29/243.521, 243.527, 29/243.53, 243.51, 798, 716; 72/391.2, 391.4, 478, 453.17, 453.19; 100/231; 227/8, 51, 52, 53, 61, 62, 63, 151, 152, 153

(56) References Cited

U.S. PATENT DOCUMENTS 1,437,245 A * 11/1922 Hinchcliff ..... 227/53
3,192,821 A * 7/1965 Siebol ..... 411/41
3,961,517 A 6/1976 DiMaio
3,981,177 A 9/1976 Di Maio et al.
4,088,004 A 5/1978 Di Maio et al.
4,425,782 A 1/1984 Todisco
4,726,504 A * 2/1988 Halbert ..... 227/8
5,469,610 A * 11/1995 Courian et al. ..... 29/243.521
6,299,398 B1 10/2001 Shinjo
6,568,236 B2 * 5/2003 Kondo et al. ..... 72/448

FOREIGN PATENT DOCUMENTS

JP 11082449 A * 3/1999 ..... F16B/19/10

* cited by examiner

*Primary Examiner*—Lowell A. Larson
(74) *Attorney, Agent, or Firm*—John D. Lister

(57) ABSTRACT

A piercing and riveting tool utilizes a rivet assembly that includes a rivet body and a mandrel. In a single operation, the tool clamps one or more workpieces in place; pierces the clamped workpiece(s) with a piercing surface of the mandrel head, prevents the premature deformation of the rivet body with the mandrel head, deforms an end of the rivet body after the end of the rivet body has passed through the workpiece (s) with the mandrel head to set the rivet, separates the mandrel head from its shank, and unclamps the workpiece(s) to which the rivet body is secured.

9 Claims, 7 Drawing Sheets

FIG. 1
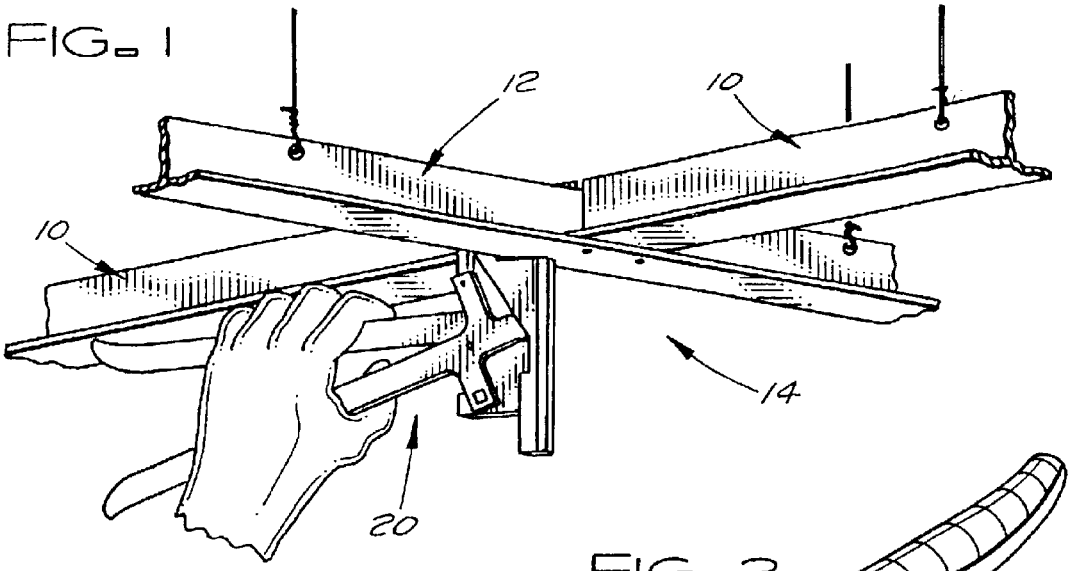
FIG. 2
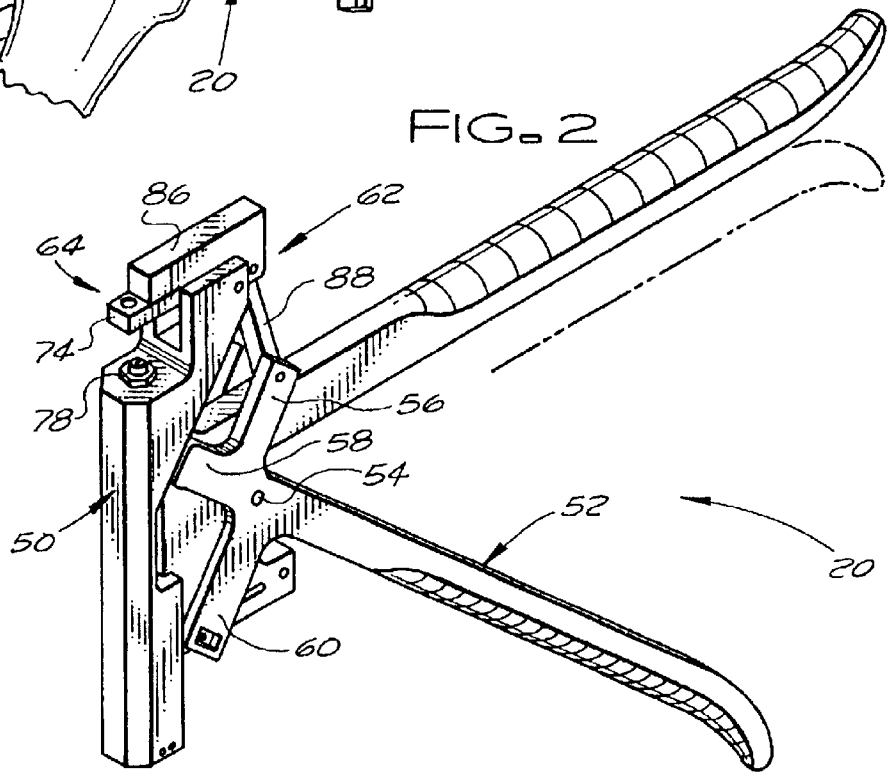
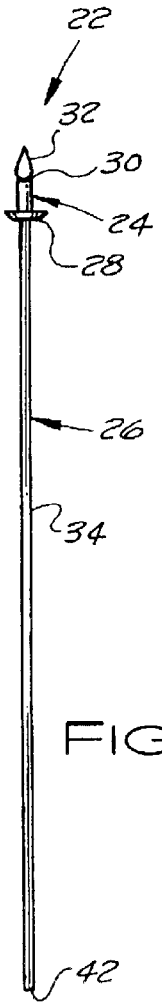
FIG. 3
FIG. 4
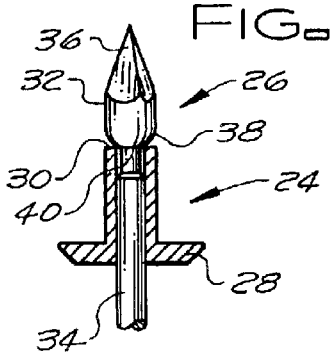
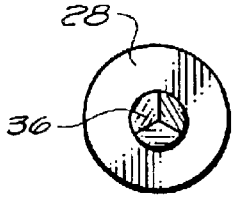
FIG. 5

PIERCING AND RIVETING TOOL, RIVET, AND METHOD

BACKGROUND OF THE INVENTION

The subject invention relates to a piercing and riveting tool, a rivet assembly that includes a rivet body and a mandrel that is used with the tool, and a method of securing a rivet body of the rivet assembly to one or more workpieces with the tool. In a single operation, the tool clamps one or more workpieces in place; pierces the clamped workpiece(s) with a piercing surface of the mandrel head, prevents the premature deformation of the rivet body with the mandrel head, deforms an end of the rivet body after the end of rivet body has passed through the workpiece(s) along with the mandrel head to set the rivet, and unclamps the workpiece(s) to which the rivet body is secured while separating the mandrel head from its shank.

Rivets are used for many applications including but not limited to securing a rivet body to a workpiece for various uses and securing two or more workpieces together with a rivet body. One common use for rivets is as a fastener for securing together the wall angle, runner and cross-tee hardware components of a suspended ceiling grid system. Once assembled the suspended ceiling grid system supports ceiling panels that rest on flanges of the angle, runner and cross-tee hardware components.

A method currently used in the assembly of such grid systems includes the following steps in connection with the installation of each of the rivets that secure the hardware components together. First flanges of two hardware components are overlapped. Then a punch tool is used to punch aligned holes through the flanges of the two hardware components to receive a rivet assembly to secure the flanges together. Next a rivet body of a rivet assembly that is loaded into a riveting tool is passed through the holes in the flanges and an end of the rivet body is deformed and set with the riveting tool to secure the two hardware components together.

This method of assembling suspended ceiling grid systems creates several problems for the installer. First, the installer must use two tools, a punch tool and a riveting tool. Secondly, the installer must maintain the holes formed by the punch tool in the flanges of the hardware components for receiving the rivet assembly in alignment while switching from the punch tool to the riveting tool or realign the holes once the installer has put the punch tool down and picked up the riveting tool. Thirdly, the installer must align the rivet assembly in the riveting tool with the holes in the flanges of the hardware components, insert the rivet assembly through the aligned holes, and deform and set the rivet body. The use of two tools, the time required to switch tools, the need to maintain holes formed in hardware component flanges in alignment or to realign the holes if they get out of alignment while switching tools, the need to align and insert a rivet assembly loaded into the riveting tool with the holes in the hardware component flanges prior to deforming and setting the rivet body, and the need to carry out these functions while the installer is working over his/her head, are time consuming and tiresome. Accordingly, there has been a need for a simpler, quicker and less tiring method of securing the hardware components of a suspended ceiling grid system together with rivets and a need for the piercing and riveting tool and rivet assembly that make such a method possible and practical and that also can be used for other riveting applications.

SUMMARY OF THE INVENTION

The subject invention provides a simpler, quicker and less tiring method of securing the hardware components of a suspended ceiling grid system together with rivets and provides a piercing and riveting tool and rivet assembly that make such a method possible and practical and that can be used for other riveting applications. The piercing and riveting tool of the subject invention is utilized with the rivet assembly of the subject invention to secure a rivet body to one or more workpieces in a single operation. The rivet assembly of the subject invention includes a rivet body and a mandrel. The mandrel of the rivet assembly includes a mandrel head and an elongated mandrel shank that is separable from the mandrel head after the rivet is set. The mandrel head has a pointed piercing surface for piercing one or more workpieces and a deforming surface that is in contact with one end of the rivet body to deform and set that end of the rivet body to secure the rivet body to the workpiece(s). In the sequential piercing and riveting operation of the subject invention, the piercing and riveting tool clamps one or more workpieces in place; pierces the clamped workpiece(s) with a piercing surface of the mandrel head, prevents the premature deformation of the rivet body with the mandrel head, deforms an end of the rivet body with the mandrel head to set the rivet after the end of the rivet body has passed through the workpiece(s), and unclamps the workpiece(s) to which the rivet body is secured while separating the mandrel head from its shank.

BRIEF DESCRIPTION OF THE DRAWINGS

FIG. 1 is a perspective view of a portion of a suspended ceiling grid showing the piercing and riveting tool of the subject invention in the process of riveting a cross-tee hardware component to a runner hardware component.

FIG. 2 is a perspective view of the piercing and riveting tool of the subject invention that shows the handle of the tool in an open position in solid line and closed position in phantom line.

FIG. 3 is a side view of the rivet assembly of the subject invention.

FIG. 4 is a partial section of the rivet assembly of FIG. 3 through the rivet body to better show the rivet mandrel head and the connection of the mandrel head to the mandrel shank.

FIG. 5 is an end view of the rivet assembly of FIGS. 3 and 4 taken from above.

DESCRIPTION OF THE PREFERRED EMBODIMENTS

Figure 6:
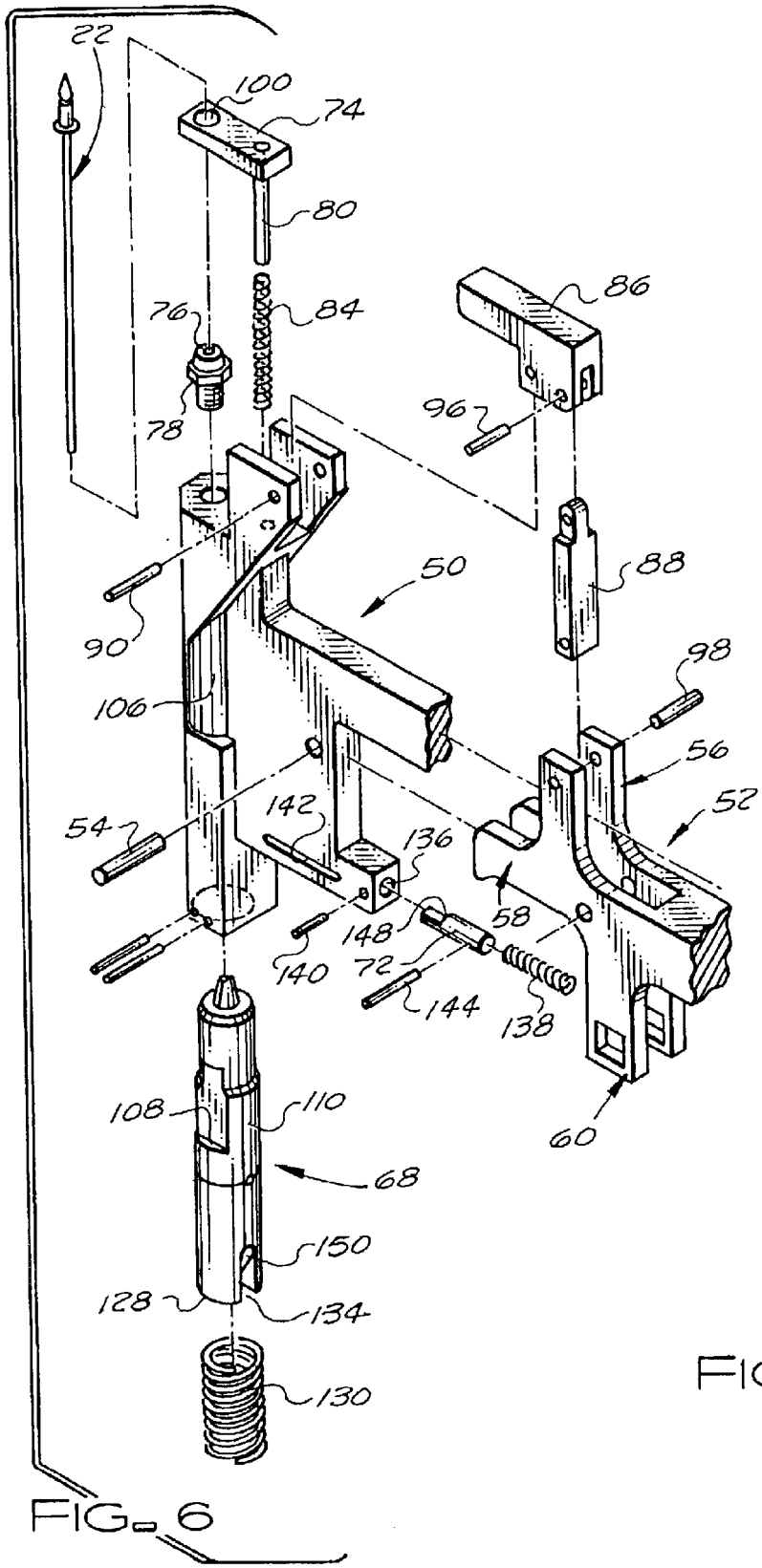
FIG. 6 is an exploded view of the piercing and riveting tool of FIG. 2 to better show the components of the tool.
Figure 7:
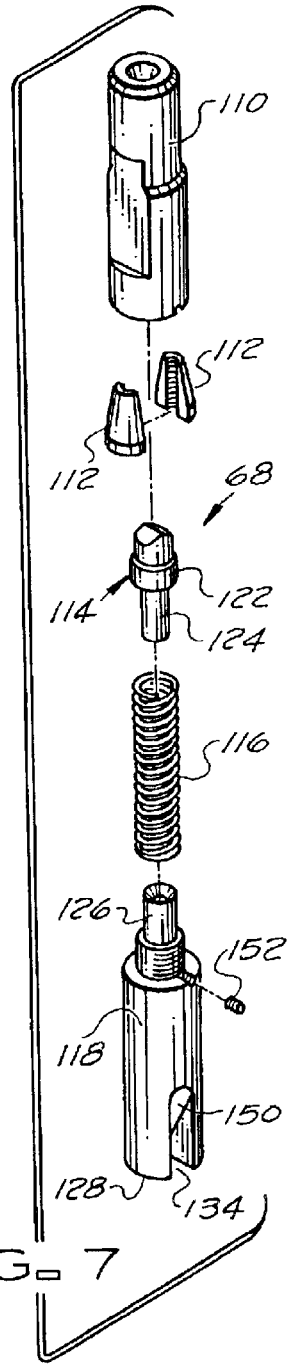
FIG. 7 is an exploded view of the collet assembly of the piercing and riveting tool of FIG. 2.

FIG. 1 shows the piercing and riveting tool 20 of the subject invention in the process of riveting a cross-tee hardware component 10 to a runner hardware component 12 in a suspended ceiling grid 14 with the rivet assembly 22 of the subject invention. While the piercing and riveting tool 20 and the rivet assembly 22 are especially well suited for riveting the hardware components of suspended ceiling grids together (e.g. riveting runners and cross-tees to wall angles and runners and cross-tees together as shown in FIG. 1), the piercing and riveting tool 20 and the rivet assembly 22 are equally well suited for many other riveting applications as will become apparent from the drawings and following description of the piercing and riveting tool 20, the rivet assembly 22, and the method of utilizing the piercing and riveting tool and rivet assembly to secure the rivet body to a workpiece or to secure workpieces together.

The rivet assembly 22 is a blind rivet assembly and includes a rivet body 24 and a mandrel 26. The rivet body 24 is tubular with an annular flange 28 at a first end and a second end 30 that is deformed and set by the mandrel to secure the rivet body 24 to a workpiece or to secure two or more workpieces together. The rivet mandrel 26 has a mandrel head 32 and an integral but separable elongated mandrel shank 34. The mandrel head 32 has an outwardly directed pointed piercing surface 36 for piercing a workpiece to which the rivet body is to be secured and a deforming surface 38, from which the mandrel shank 34 projects, for deforming and setting the second end 30 of the rivet body 24. The deforming surface 38 of the mandrel head 32 is symmetrical relative to the mandrel shank 34, preferably with a generally spherical contour, and engages or rests on the second deformable end 30 of the rivet body 24. The elongated mandrel shank 34 has a first end 40 that is integral with and extends axially from the mandrel head 32 and a second free end 42. The mandrel shank 34 is slidably received in and passes from the mandrel head 32 through the rivet body 24 and beyond the annular flange 28 at the first end of the rivet body to provide a stem to be gripped and pulled by the piercing and riveting tool 20 to effect a deformation and setting of the second deformable end 30 of the rivet body 24 by the deforming surface 38 of the mandrel head to secure the rivet body 24 to a workpiece or to secure two or more workpieces together with the rivet body. The mandrel shank 34 has a necked in or otherwise weakened portion at the first end 40 for separating the mandrel head 32 from the mandrel shank 34 after the second end 30 of the rivet body 24 is deformed and set by the deforming surface 38 of the mandrel head.

The rivet body 24 and the rivet mandrel 26 of the rivet assembly 22 are made of steel, stainless steel, aluminum or other metals commonly used in the fabrication of rivets. However, the metal or metals used to form the rivet assembly are selected to assure that the pointed piercing surface 36 of the mandrel head 32 will pierce the workpiece to which the rivet body is to be attached or the workpieces being secured together by the rivet body. It is also contemplated that the rivets will be available in all standard sizes used in the industry.

As shown in FIG. 2, the piercing and riveting tool 20 includes a body 50 and an actuating handle 52 for actuating the operation of the piercing and riveting tool. The actuating handle 52 is pivotally mounted to the tool body 50 by a fulcrum pin 54 and preferably pivots through an arc of about 40° when actuating the piercing and riveting tool 20. As shown, the actuating handle 52 includes first, second and third forked arms 56, 58 and 60 for actuating different components of the piercing and riveting tool. During the actuation of the tool 20, the first forked arm 56 of the actuating handle 52, through linkage 62, actuates a clamping assembly 64 of the piercing and riveting tool 20 for clamping and retaining a workpiece or workpieces 44 in place and causing the workpiece(s) to be pierced during the actuation of the piercing and riveting tool 20 by the pointed piercing surface 36 of the mandrel head 32 of a rivet assembly 22 loaded into the tool. During the actuation of the tool 20, the second forked arm 58 of the actuating handle, through cam heads 66, actuates the collet assembly 68 of the piercing and riveting tool 20 to grip and pull the elongated mandrel shank 34 of a rivet assembly 22 loaded into the piercing and riveting tool to deform and set the second end 30 of the rivet body 24 with the deforming surface 38 of the rivet mandrel head 32 and secure the rivet body to a workpiece or secure workpieces 44 together with the rivet body. During the actuation of the tool 20, the third forked arm 60 of the actuating handle, through a cam mechanism 70, withdraws a support or stop pin 72 that supports the free end 42 of the mandrel shank of a rivet assembly 22 loaded into the tool and the collet assembly 68 of the tool while a workpiece or workpieces 44 are being pierced by the pointed piercing surface 36 of the mandrel head 32 of the rivet assembly. By supporting the free end 42 of the mandrel shank 34 as the mandrel is piercing workpiece(s) 44, the mandrel head 32 is prevented from prematurely deforming and setting the second end 30 of the rivet body 24 with the deforming surface 38 of the mandrel head as the mandrel head 32 is pushed through the workpiece(s) 44 by the piercing and riveting tool. While, as shown, the pivotal movement of the actuating handle 52 is accomplished by gripping and squeezing together the actuating handle 52 and tool body 50 by hand, it is also contemplated that the pivotal movement of the three forked arms 56, 58 and 60 of the actuating handle 52 may be effected by the substitution of pneumatically or hydraulically actuated piston assemblies (not shown), commonly used in hand held tools, for the gripping portion of the actuating handle 52.

The clamping assembly 64 includes a backing plate 74 that is mounted to the tool body 50 for reciprocal movement, preferably straight linear movement, toward and away from an anvil surface 76 of the tool body. The anvil surface 76 of the tool body, typically provided by a nosepiece 78, supports a rivet body 24 of a rivet assembly loaded into the piercing and riveting tool 20 while the rivet body is being secured to a workpiece or workpieces 44 with the tool. The backing plate 74 is mounted to the tool body 50 for reciprocal movement through a spring loaded dowel pin 80. Preferably, the dowel pin 80 is secured to the backing plate 74 by being press fit into a hole in the backing plate. The dowel pin extends from the dowel plate 74 into a hole 82 in the tool body that has a transverse cross section conforming to the transverse cross section of the dowel pin. The dowel pin 80 is slidably received in the hole 82 and a coil spring 84 is housed in the hole between the free end of the dowel pin and a bottom of the hole 82.

The actuating linkage 62 operatively connecting the first forked arm 56 of the actuating handle 52 to the backing plate 74 includes an L-shaped cam member 86 and a link 88. The L-shaped cam member 86 is pivotally mounted to the tool body 50 by a fulcrum pin 90. A first end portion 92 of the L-shaped cam member 86 slidably engages an outwardly facing surface of the backing plate 74. A second end portion 94 of the L-shaped cam member 86 is pivotally connected to the link 88 through a fulcrum pin 96 and the link 88 is pivotally connected to an end portion of the first forked arm 56 of the actuating handle 52 by a fulcrum pin 98. As viewed in FIGS. 8 to 12, the arcuate movement of the forked arm 56 of the actuating handle 52 during the actuation of the piercing and riveting tool 20 causes the L-shaped cam member 86 to first pivot counter clockwise about the fulcrum pin 90 to move the backing plate 74 toward the anvil surface 76 of the nosepiece 78 and then clockwise about the fulcrum pin 90 to move the backing plate 74 away from the anvil surface 76 of the nosepiece 78. The coil spring 84 through the dowel pin 80 urges the backing plate 74 outwardly toward and maintains the outwardly facing surface of the backing plate 74 in contact with the first end portion 92 of the L-shaped cam member 86 throughout the sequential actuation of the piercing and riveting tool 20. Thus, the movement of the first end portion 92 of the L-shaped cam member 86 throughout the actuation of the L-shaped cam member 86 by the first forked arm 56 of the actuating handle 52 controls the movement of the backing plate 74 toward and away from the anvil surface 76 of the nosepiece 78. Movement of the backing plate 74 toward the anvil surface 76 forces the workpiece(s) 44 against the pointed piercing surface 36 of the mandrel head 32 of a rivet assembly loaded into the piercing and riveting tool 20 to pierce the workpiece (s) 44 with the pointed piercing surface of the mandrel head. Once the workpiece(s) 44 have been pierced by the pointed piercing surface 36 of the mandrel head 32 and the second deformable end 30 of the rivet body 24 is projecting through and beyond the workpiece(s) 44, movement of the backing plate 74 toward the anvil surface 76 of the nosepiece 78 clamps the workpiece(s) between the backing plate 74 and the rivet body flange 28 resting on the anvil surface 76. It should be noted that, preferably, the workpiece(s) 44 are tightly clamped between the backing plate 74 and rivet body flange 28 resting on the anvil surface 76 of the nosepiece 78. However, provided the deformable end 30 of the rivet body 24 extends through and project beyond the workpiece(s) 44, the workpiece may be somewhat loosely clamped between the backing plate 74 and the rivet body flange 28 resting on the anvil surface 76. Movement of the backing plate 74 away from the anvil surface 76 of the nosepiece 78 unclamps the workpiece(s) 44 so that the workpiece(s) can be removed from the tool or the tool removed from the workpiece(s).

The backing plate 74 is provided with a recess or preferably a hole 100 for receiving the pointed piercing surface 36 of the mandrel head 32 and the second deformable end 30 of the rivet body 24 of a rivet assembly loaded into the piercing and riveting assembly 20 after a workpiece or workpieces 44 have been have been pierced by the pointed surface 36 of the mandrel head 32 and the second deformable end 30 of the rivet body 24 is projecting through and beyond the workpiece(s). Where a recess is utilized in the backing plate 74, the recess is located in the surface of the backing plate opposing the anvil surface 76 of the nosepiece 78 and is axially aligned with a hole 102 in the anvil surface 76 of the nosepiece 78 for receiving the mandrel shank 34 of a rivet assembly loaded into the piercing and riveting tool. The hole 102 passes completely through the nosepiece 78. Where a hole 100 is utilized in the backing plate 74, the hole 100 passes from the surface of the backing plate 74 opposing the anvil surface 76 of the nosepiece 78 to the outwardly facing surface of the backing plate 74 and is axially aligned with the hole 102 in the anvil surface 76 of the nosepiece 78 for receiving the mandrel shank 34 of a rivet assembly loaded into the piercing and riveting tool.

The collet assembly 68 is slidably housed for reciprocal movement within an elongated cavity 104 of the tool body 50. The collet cavity 104 is typically a cylindrical cavity that extends completely through the tool body 50 and has opposed openings 106 (only one of which is shown) in a mid portion of the cavity through which the cam heads 66 on the ends of the fork members of the second forked arm 58 of the actuating handle 52 can contact shoulders 108 (only one of which is shown) on a collet case 110 of the collet assembly 68 to move the collet assembly during the actuation of the piercing and riveting tool. As shown, the collet cavity 104 has a first end that is reduced in diameter relative to the portion of the cavity housing the collet assembly 68 and to which the nosepiece 78 forming the anvil surface 76 of the tool body 50 is threadably or otherwise secured. Preferably, the nosepiece 78 is removably secured to the first end of the collet cavity 104 so that different nosepieces can be utilized with the tool for different size rivet assemblies.

Figure 9:
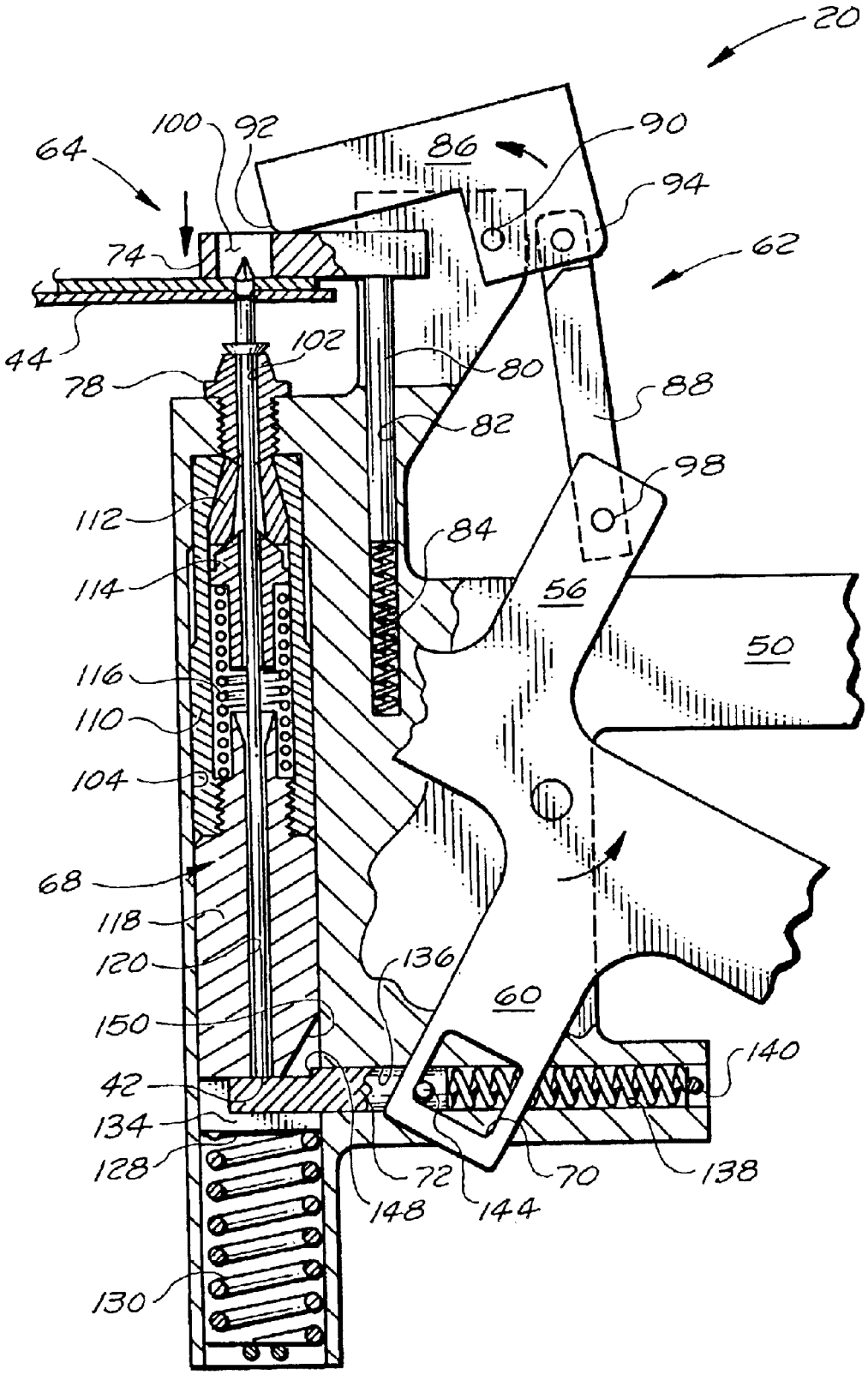
FIG. 9 is a side view of the piercing and riveting tool of FIG. 2, partially in section, with the tool farther through its sequential operation than shown in FIG. 8B, the piercing surface of the mandrel head piercing the workpieces, and the mandrel shank supported at its free end and confined laterally to prevent premature deformation of the rivet body by the mandrel head during the piercing of the workpieces with the mandrel head.
Figure 11:
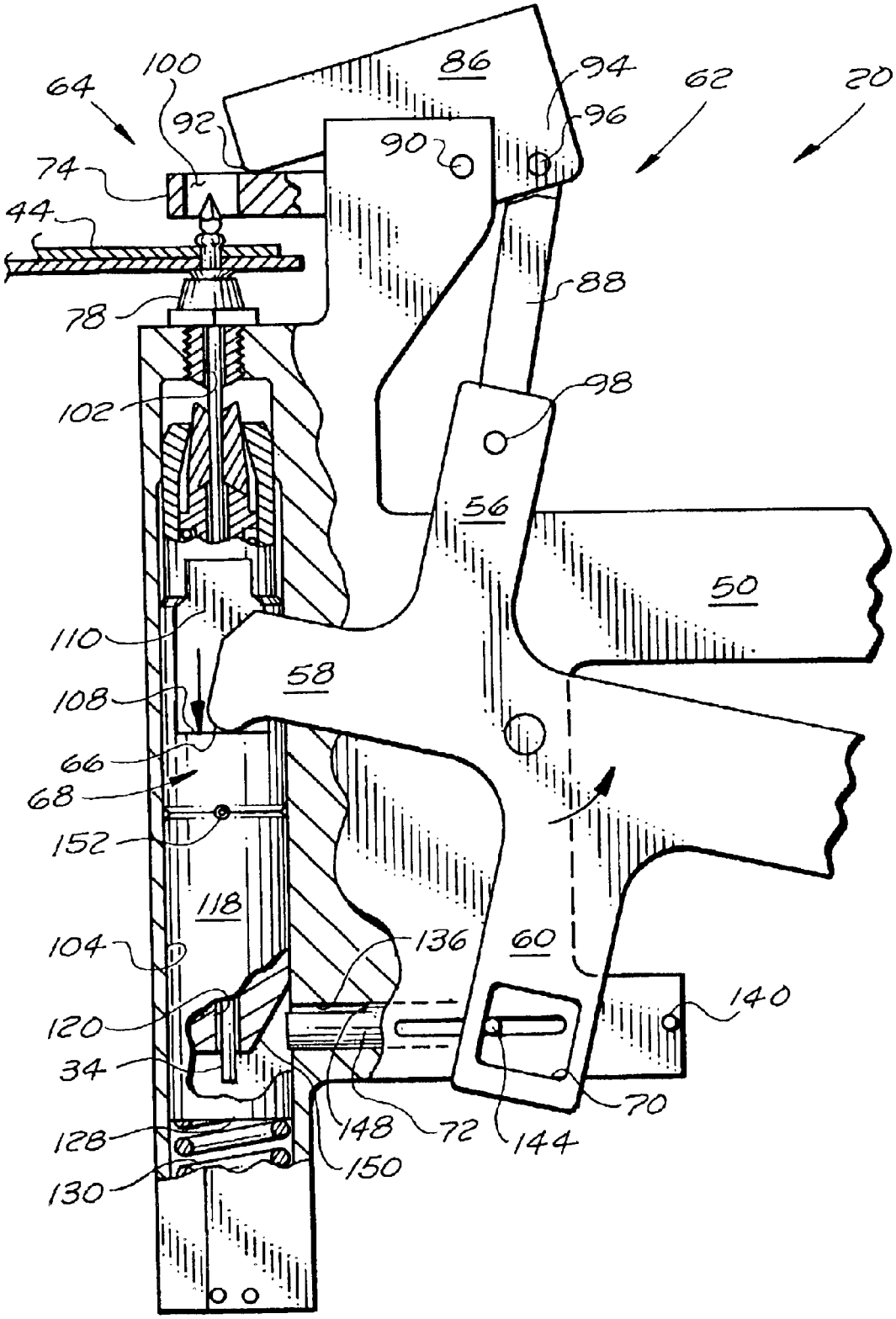
FIG. 11 is a side view of the piercing and riveting tool of FIG. 2, partially in section, with the tool farther through its sequential operation than shown in FIG. 10, the workpieces being unclamped, and the mandrel shank being gripped and pulled by the jaws of the collet assembly to deform the deformable end of the rivet body that is extending beyond the workpieces with the mandrel head.

A collet assembly 68 that may be utilized in the piercing and riveting tool 20 includes the collet case 110, jaws 112, a jaw pusher 114, a jaw pusher coil spring 116, and a collet assembly end piece 118. The elongated collet case 110 has an elongated collet case cavity that extends axially completely through the collet case 110 from a first end to a second end of the collet case. The cavity in the collet case 110 houses the jaws 112, the jaw pusher 114, the jaw pusher coil spring 116, and an extension of the collet assembly end piece 118. The cavity in the collet case 110 is tapered inwardly at the first end of the cavity to form a frustoconical shaped interior surface. The jaws 112 have outer surfaces that conform in shape to the frustoconical shaped interior surface of the first end portion of the collet case 110 and that are slidably housed in the tapered first end portion of the collet case. The jaws 112 can be moved axially within the collet case 110 from a first retracted position to a second extended position. The jaw pusher 114, biased by the jaw pusher coil spring 116, urges or moves the jaws 112 toward their second extended position. In the first retracted position, the jaws 112 are not forced together by the tapered interior surface of the first end portion of collet case 110 and can be moved or spread apart (e.g. as shown in FIG. 9 where the jaws are completely within the cavity and spread apart by a frustoconical surface of the nosepiece 78). In the second extended position, the jaws are clear of the nosepiece 78 and forced together by the tapered interior surface of the first end portion of the collet case 110 as the jaws are moved toward the first end of the collet case by the jaw pusher 114 (e.g. as shown in FIG. 11 where the end portions of the jaws 112 extend out of and beyond the first end of the collet case 110). The inner surfaces of the jaws 112 are sized and shaped to grip the mandrel shank 34 of a rivet assembly 22 loaded into the tool when the jaws are in the second extended position.

The collet assembly end piece 118 is an elongated piece that contains an axially extending hole 120 that extends completely through the collet assembly end piece from a first end to a second end of the end piece. The axially extending hole 120 is flared at the first end, e.g. the flared frustoconical surface preferably being at an angle of about 30° to about 45° to the longitudinal axis of the hole 120, to facilitate the insertion of the free end 42 of the mandrel shank 34 into the hole 120. The collet assembly end piece 118 serves several functions.

First, the collet assembly end piece 118 closes the second end of the collet case 110 and supports the jaw pusher coil spring 116, which extends between the collet assembly end piece 118 and the jaw pusher 114, so that the spring 116 urges the jaw pusher into contact with and maintains the jaw pusher in contact with the jaws 112.

Second, the collet assembly end piece 118 along with the jaw pusher 114, the jaws 112, and the nosepiece 78 confine or restrict lateral flexing of the mandrel shank 34 of a rivet assembly 22 loaded into the piercing and riveting tool 20 to prevent the mandrel shank 34 from flexing, while the pointed piercing surface 36 of the mandrel head 32 is piercing workpiece(s) 44, to the extent that the deforming surface 38 of the mandrel head 32 prematurely deforms and sets the deformable end 30 of the rivet body 24 before the deformable end of the rivet body passes through and beyond the workpiece(s) 44. The jaw pusher 114 includes a head portion 122 for pushing the jaws 112 and a stem 124 that extends part of the way through the jaw pusher coil spring 116. The jaw pusher 114 has an axially extending hole passing completely through the jaw pusher 114 from the head end to a stem end of the jaw pusher. The collet assembly end piece 118 has a stem 126 extending from the first end of the collet assembly end piece that extends part of way through the jaw pusher coil spring 116 from the end of the coil spring opposite the end in contact with the head portion 122 of the jaw pusher. The axially extending holes in the collet assembly end piece 118, the jaw pusher 114 and the nosepiece 78 are sized in diameter and the stem 124 of the jaw pusher 114 and the stem 126 of the collet assembly end piece 118 extend through the jaw pusher coil spring 116 to such an extent that the axially extending holes in the collet assembly end piece 118, the jaw pusher 114, and the nosepiece 78, plus the jaws 112 laterally confine the mandrel shank 34 of a rivet assembly loaded into the tool to prevent a flexing of the mandrel shank 34 that would cause a premature setting of the rivet body 24.

Third, the second end of the collet assembly end piece 118 has an end face 128 against which a first end of a coil spring 130 abuts to urge or force the entire collet assembly 68 toward the first end of the collet cavity 104 in the tool body 50 and the jaws 112 of the collet assembly 68 into contact with the frustoconical shaped surface on the nosepiece 78 to spread the jaws apart except during the portion of the actuating cycle of the piercing and riveting tool where the jaws 112 of the collet 68 assembly grip and pull the mandrel shank 34 of a rivet assembly 22 loaded into the tool to set the rivet body 24. The second end of the coil spring 130 is held within the collet cavity 104 by a pin 132 or other retaining means that preferably will permit a mandrel shank 34 separated from a mandrel head 32 of a rivet assembly 22 to be discharged from the second end of the collet cavity.

Fourth, the collet assembly end piece 118 in cooperation with the support pin 72 provide support for the free end 42 of a mandrel shank 34 of a rivet assembly 22 loaded into the piercing and riveting tool 20 to prevent a premature deformation and setting of the rivet body 24 of the rivet assembly when the pointed piercing surface 36 of the mandrel head 32 is piercing one or more workpieces 44. A diametrically extending slot 134 in the end face 128 of the collet assembly end piece 118 for receiving a first end portion of the support pin 72 intersects the axial hole 120 through the collet assembly end piece 118 for receiving the mandrel shank 34 of a rivet assembly 22 loaded into the tool. The collet case 110 and the collet assembly end piece 118 each have threaded grooves therein which when aligned together form a threaded hole into which a set screw 152 is threaded to assure that the collect case 110 and the collect assembly end piece 118 are properly oriented with respect to each other. The proper orientation of the collet case 110 to the collet assembly end piece 118 assures that the shoulders 108 on the collet case 110 can be actuated by the cam heads 66 on the forked arm 58 of the actuating handle 52 while the slot 134 in the end face 128 of the collect assembly end piece 118 is a aligned with the support pin cavity 136 to permit movement of the support pin 72 into and out of the slot 134.

As shown in the figures, the support pin 72 is slidably housed for reciprocal movement in a support pin cavity 136 in the tool body 50. The support pin cavity 136 in the tool body 50 intersects the collet assembly cavity 104 at right angles so that the support pin 72 can reciprocate between a first extended position to a second retracted position. In the first extended position, the first end portion of the support pin 72 extends into the slot 134 and covers the axially extending hole 120 for the mandrel shank in the collet assembly end piece 118 to support the free end 42 of a mandrel shank 34 of a rivet assembly loaded into the tool. In the second retracted position, the support pin 72 is retracted from the slot 134, no longer covers the axially extending hole 120 in the collet assembly end piece 118 to support the free end 42 of the mandrel shank 34, and no longer prevents the collet assembly 68 from being moved away from the first end of the collet assembly cavity 104 to grip and pull a mandrel shank 34 of a rivet assembly 22 loaded into the tool.

A coil spring 138 housed in the support pin cavity 136 and pressing against the second end of the support pin 72 urges the support pin into its first extended position. The coil spring 138 is retained in the support pin cavity by a retaining pin 140 or other appropriate retaining means. The support pin cavity 136 has opposed slots 142 (only one of which is shown) for receiving a cross pin 144 that passes through the support pin 72. The cross pin 144 extends outward through both slots 142 beyond both sides of the tool body 50. The free ends of the cross pin 144 are received in cam openings 146 in the two members of the forked arm 60 so that movement of the forked arm 60 during the sequential actuation of the piercing and riveting tool moves the support pin 72 from its first extended position to its second retracted position. The support pin 72 has a shoulder 148 that abuts an inclined surface 150 of the diametrically extending slot 134 in the collet assembly end piece 118 to limit the movement of the support pin. The inclined surface 150 of the slot 134 enables the collet assembly 68 to be moved away from the first end of the collet assembly cavity 104 before the support pin 72 is fully retracted to its second retracted position during the actuation of the piercing and riveting tool 20.

In the method of using the piercing and riveting tool 20 and the rivet assembly 22 to secure the rivet body 24 of the rivet assembly 22 to a workpiece or to secure two or more workpieces 44 together with the rivet body 24 of the rivet assembly 22, the following steps are followed.

Figures 8A, 8B:
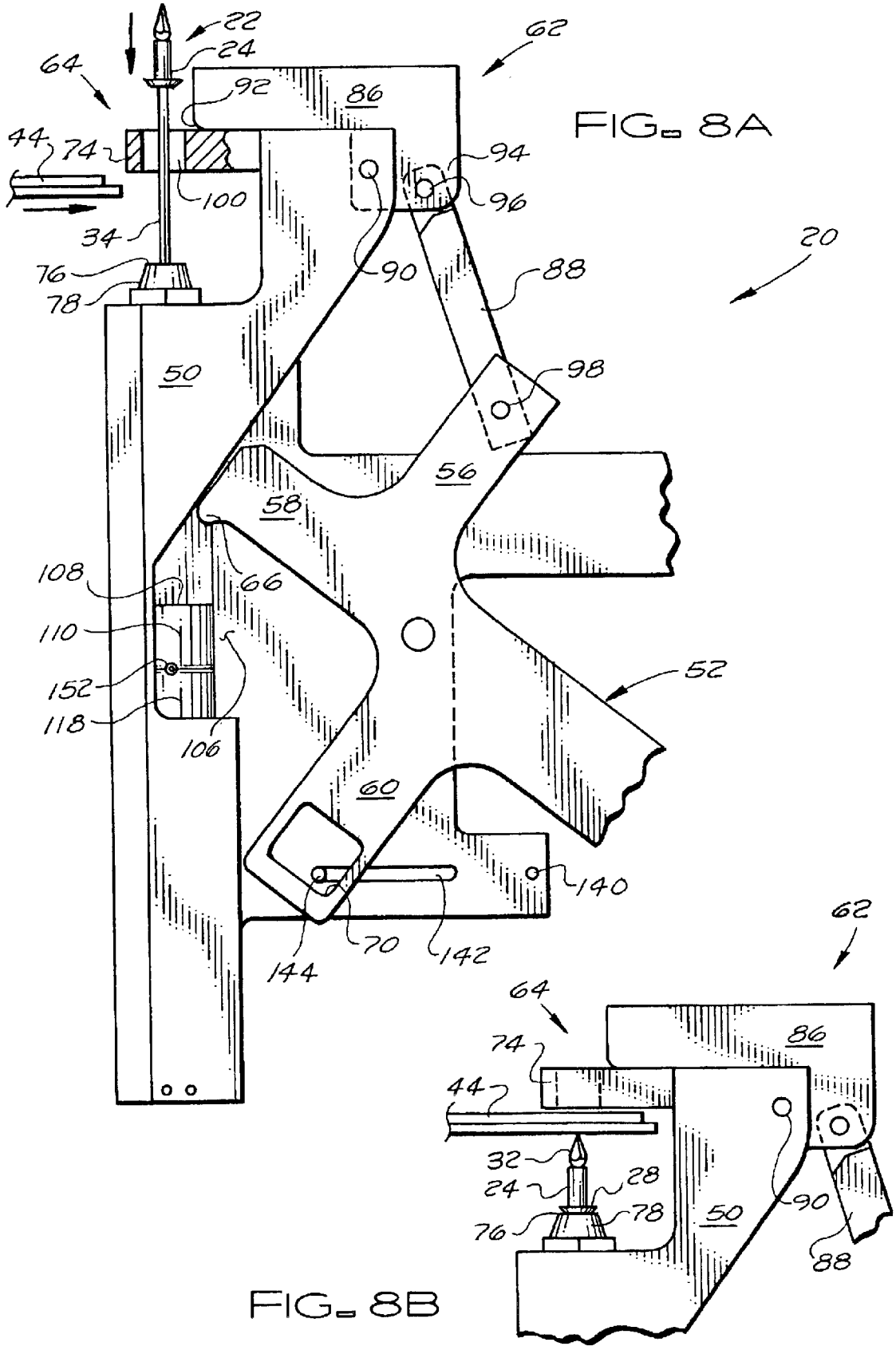
FIG. 8A is a side view of the piercing and riveting tool of FIG. 2 showing the rivet assembly of FIG. 3 being loaded into the tool.
FIG. 8B is a partial side view of the piercing and riveting tool of FIG. 2 showing the rivet assembly of FIG. 3 loaded into the tool and the sequential operation of the tool initiated to clamp the workpieces between the piercing surface of the rivet mandrel head and a backing plate of the tool.

First, with reference to FIG. 8A, a rivet assembly 22 is loaded into the piercing and riveting tool 20 by inserting the mandrel shank 34 of the rivet assembly through the axially aligned holes: in the anvil surface 76 of the nosepiece 78, in the open jaws 112 of the collet assembly 68, in the jaw pusher 114 of the collet assembly 68, and in the collet assembly end piece 118. When the rivet assembly 22 is loaded into the tool 20, the annular flange 28 of the rivet body 24 rests on the anvil surface 76 of the nosepiece 78 as shown in FIG. 8B. In addition, when the rivet assembly is loaded into the tool 20, the free end 42 of the mandrel shank 34 rests on the support pin 72 and the mandrel shank 34 is confined by the sidewalls of the axially aligned holes in the anvil surface 76 of the nosepiece 78, in the open jaws 112 of the collet assembly 68, in the jaw pusher 114 of the collet assembly 68, and in the collet assembly end piece 118 to limit the lateral deflection of the mandrel shank 34 (as shown in FIG. 9) so that as the pointed piercing surface 36 of the mandrel head 32 pierces the workpiece(s) 44 during the piercing and riveting operation the deforming surface 38 of the mandrel head does not prematurely deform and set the rivet body 24.

Figure 10:
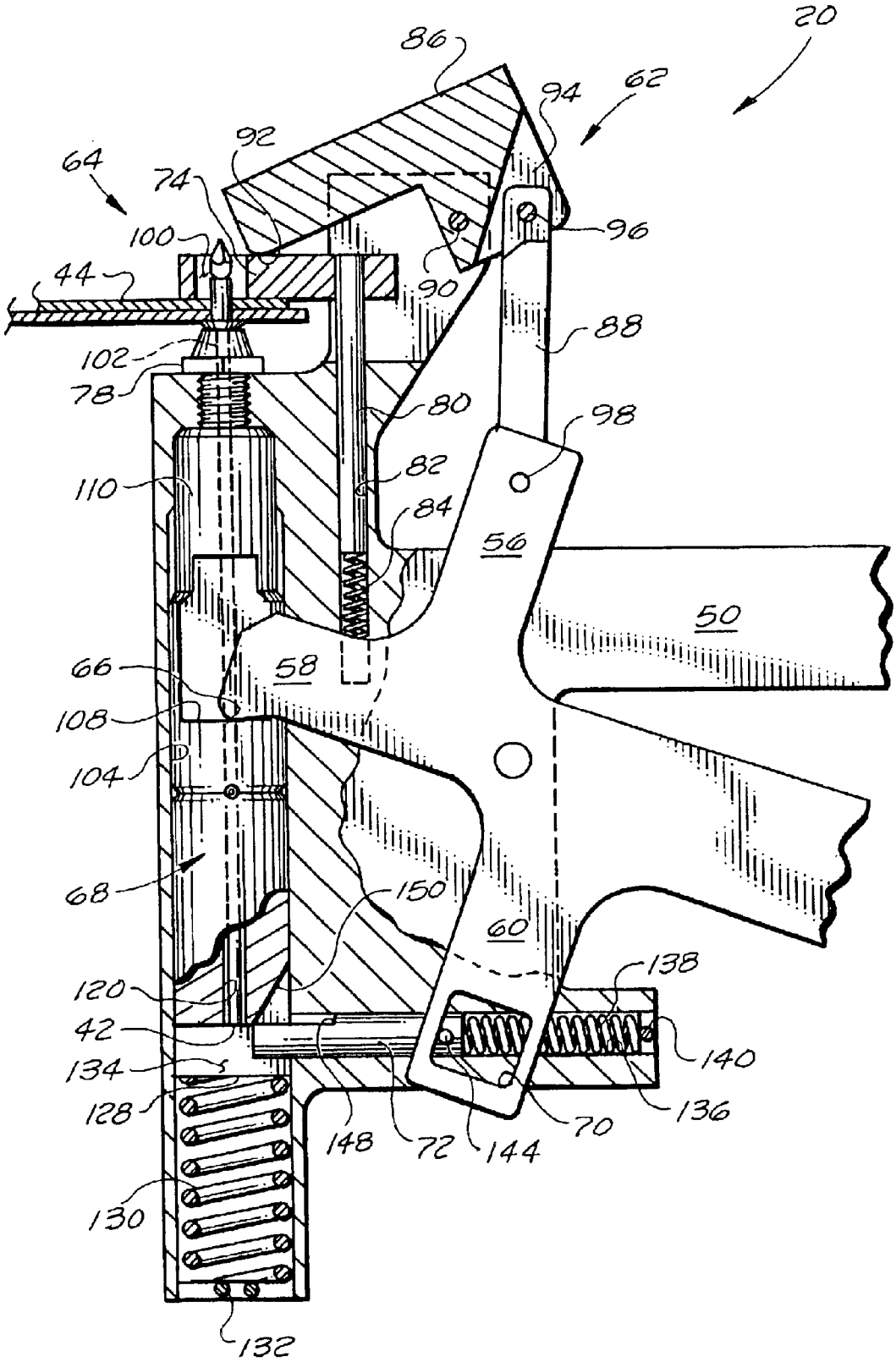
FIG. 10 is a side view of the piercing and riveting tool of FIG. 2, partially in section, with the tool farther through its sequential operation than shown in FIG. 9, the workpieces clamped between the backing plate and an annular flange of the rivet body that is resting on an anvil surface of the tool, a deformable end of the rivet body extending through and beyond the workpieces and ready for deformation to set the rivet, and the support pin for the free end of the mandrel shank in the process of being retracted.

Second, with the rivet assembly 22 loaded into the piercing and riveting tool 20 and the workpiece or workpieces 44 inserted between the pointed piercing surface 36 of the mandrel head 32 and the backing plate 74 as shown in FIG. 8B, the sequential operation of the tool is initiated by pivoting the actuating handle 52 toward the tool body 50 to clamp the workpiece(s) 44 between the pointed piercing surface 36 of the rivet mandrel head 32 and the backing plate 74 of the tool. In a preferred embodiment of the piercing and riveting tool 20, the actuating handle 52 pivots through about 40° during the sequential actuation of the tool. The pivotal movement of the actuating handle 52 through approximately the first 20° of movement typically effects the piercing of the workpiece(s) 44 by the pointed piercing surface 36 of the mandrel head 32 (as shown in FIG. 9) followed by the clamping of the workpiece(s) between the backing plate 74 and the rivet body flange 28 that rests on the anvil surface 76 of the nosepiece 78. The deformable end 30 of the rivet body 24 projects through and beyond the workpiece(s) 44 (as shown in FIG. 10). As mentioned above, during the piercing of the workpiece(s) 44 with the piercing surface 36 of the mandrel head 32, the free end 42 of the mandrel shank 34 is supported by the support pin 72 and the mandrel shank 34 is confined by the sidewalls of the axially aligned holes in the anvil surface 76 of the nosepiece 78, in the open jaws 112 of the collet assembly 68, in the jaw pusher 114 of the collet assembly 68, and in the collet assembly end piece 118 to limit the lateral deflection of the mandrel shank 34 (as shown in FIG. 9) so that as the pointed piercing surface 36 of the mandrel head 32 pierces the workpiece(s) 44 during the piercing and riveting operation, the deforming surface 38 of the mandrel head does not prematurely deform and set the rivet body 24. As shown in FIG. 9, the support pin 72 is about to be retracted from its extended mandrel shank supporting position to its retracted position by further pivotal movement of the actuating handle 52.

Figure 12:
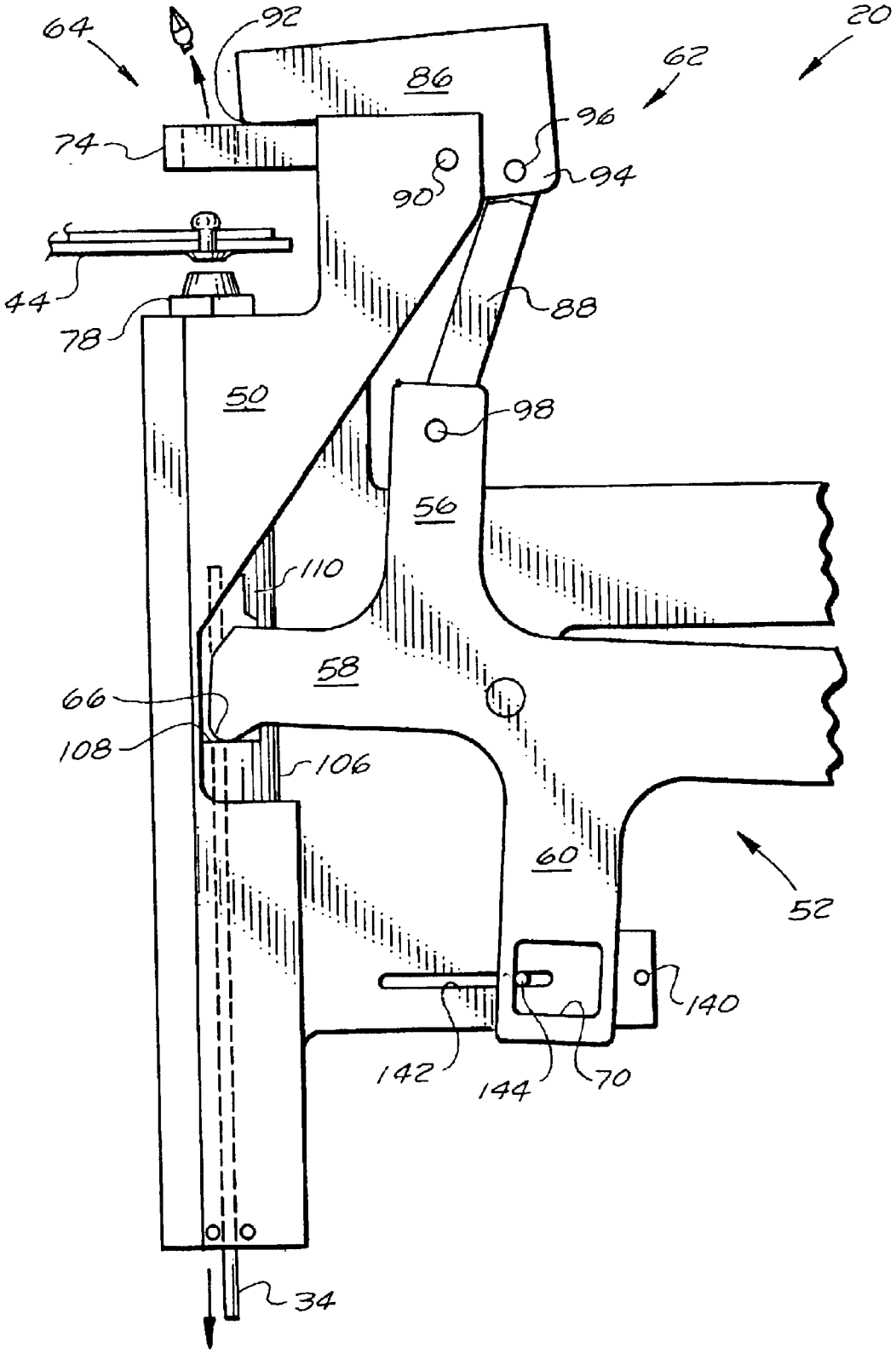
FIG. 12 is a side view of the piercing and riveting tool of FIG. 2, partially in section, with the tool at the end of its sequential operation, the workpieces unclamped and secured together by the rivet body, the mandrel head separated from the mandrel shank, and the mandrel head and the mandrel shank both being discharged from the tool.

The pivotal movement of the actuating handle 52 through approximately the final 20° of movement as shown in FIGS. 10, 11 and 12 deforms and sets the deformable end 30 of the rivet body 24 with the deforming surface 38 of the mandrel head 32 and separates the mandrel head 32 from the mandrel shank 34. With the deformable end 30 of the rivet body 24 projecting through and beyond the workpiece(s) 44 and the workpiece(s) clamped between the backing plate 74 and the annular flange 28 of the rivet body that rests on the anvil surface 76 of the tool 20 as shown in FIG. 10, the deformable end 30 of the rivet body 24 is ready for deformation to set the rivet body. As the actuating handle 52 moves from the position shown in FIG. 9 through the position shown in FIG. 10 to the position shown in FIG. 11, the support for the free end 42 of the mandrel shank 34 is withdrawn and the collet assembly 68 is retracted from the nosepiece 78. As the collet assembly 68 is retracted from the nosepiece 78, the jaws 112 are moved out of contact with the surface of the nosepiece 78 that keeps the jaws 112 spread apart and out of gripping engagement with the mandrel shank 34 and the jaws 112, actuated by the jaw pusher 114 through the action of the jaw pusher coil spring 116, grip the mandrel shank 34. As the collet assembly 68 is retracted further from the nosepiece 78, the collet assembly pulls the rivet mandrel 26 inward and the inward movement of the mandrel head 32 deforms the deformable end 30 of the rivet body 24 with the deforming surface 38 of the mandrel head to set the rivet body 24 and secure the rivet body 24 to a workpiece or secure two or more workpieces together with the rivet body 24. Finally, the inward pull by the collet assembly 68 on the mandrel shank 34 separates the mandrel head 32 from the mandrel shank 34 as shown in FIG. 12.

As shown in FIGS. 11 and 12, as the rivet mandrel 26 is being pulled inward by the collet assembly 68, the backing plate 74 of the clamping assembly 64 is being moved away from the anvil surface 76 of the nosepiece 78 and the workpiece(s) 44 can be easily removed from the tool 20 once the rivet body 24 is set. Once the mandrel head 32 is separated or pops off of the mandrel shank 34, the mandrel shank is free to pass or fall out of the end of the collet assembly cavity 104 as shown in FIG. 12. When the operator relaxes his/her grip on the piercing and riveting tool 20 so that the actuating handle 52 can return to it initial position, the dowel coil spring 84 returns the backing plate 74 to it initial position, the coil spring 130 returns the collet assembly 68 to its initial position, and the coil spring 138 returns the support pin 72 to its initial position. Now, the piercing and riveting tool 20 is ready for the loading of another rivet assembly 22.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A hand held and actuated combination piercing and riveting tool for securing together workpieces including the workpieces of suspended celling grid systems with a rivet assembly loaded into the tool, the rivet assembly comprising a rivet body and a mandrel with an elongated mandrel shank; the rivet body being tubular with an annular flange at a first end and a second end to be deformed and set by the mandrel to secure the rivet body to a workpiece; the mandrel having a mandrel head with an outwardly directed pointed piercing surface for piercing a workpiece to which the rivet is to be secured and a deforming surface for deforming and setting the second end of the rivet body; the surface of the mandrel head for deforming and setting the second end of the rivet body engaging the second end of the rivet body; the elongated mandrel shank having a first end that is integral with and extends axially from the mandrel head and a second free end; the mandrel shank slidably passing from the mandrel head through the rivet body and beyond the first end of the rivet body to be gripped and pulled to effect a deformation and setting of the second end of the rivet body by the deforming surface of the mandrel head to secure the rivet body to a workpiece; and the mandrel shank having a weakened portion for separating the mandrel head from the mandrel shank after the second end of the rivet body is deformed and set by the deforming surface of the mandrel head; the hand held and actuated piercing and riveting tool comprising:

a tool body;

the tool body having an anvil surface for supporting the annular flange at the first end of the rivet body of a rivet assembly loaded into the tool; the anvil surface having an opening therein for receiving the elongated mandrel shank of a rivet assembly loaded into the tool so that the elongated mandrel shank of a rivet assembly loaded into the tool can be inserted through the anvil surface and into a reciprocating mandrel shank puller means that is housed within the tool body for gripping and pulling the elongated mandrel shank or a rivet assembly loaded into the tool to deform and set the second end of the rivet body of a rivet assembly loaded into the tool with the deforming surface of the mandrel head of the rivet assembly; the tool body housing having means for preventing relative movement between the deforming surface of the mandrel head and the second end of the rivet body while a workpiece is being pierced to prevent the deforming surface of the mandrel head from prematurely deforming the second end of the rivet body of the rivet assembly while a workpiece is being pierced;

the tool body having a backing plate opposing and spaced from the anvil surface of the tool body reciprocative mounting means mounting the backing plate on the tool body for relative reciprocative movement relative to the anvil surface of the tool body so that the backing plate and the anvil surface of the tool body can be moved relative to each other from a first spaced apart position to a second position for clamping a workpiece between the backing plate and the anvil surface of the tool body, piercing the workpiece with the pointed surface of the mandrel head of a rivet assembly loaded into the tool, and passing the second end of the rivet body and the mandrel head of a rivet assembly loaded into the tool completely through a workpiece, and be moved from the second position away from each other back to the first position for releasing a workpiece previously clamped between the backing plate and the anvil surface of the tool body; and hand actuated actuating means for moving the backing plate from the first position to the second position to clamp a workpiece between the backing plate and the anvil surface of the tool body, to pierce the workpiece with the pointed surface of the mandrel head of a rivet assembly loaded into the tool, and to pass the second end of the rivet body and the mandrel head of a rivet assembly loaded into the tool completely through a workpiece, and for subsequently moving the shank puller to grip and pull the elongated mandrel shank of a rivet assembly loaded into the tool to deform and set the second end of the rivet body of a rivet assembly loaded into the tool with the deforming surface mandrel head of the rivet assembly, and moving the backing plate from the second position beck to the first position.

2. The hand held and actuated combination piercing and riveting tool according to claim 1, wherein:

the backing plate has an opening means therein through which a rivet assembly can be loaded into the tool and for receiving the pointed end of the mandrel head of a rivet assembly loaded into the tool that has been passed through a workpiece.

3. The hand held and actuated combination piercing and riveting tool according to claim 2, wherein;

the hand actuated actuating means includes a handle pivotally mounted on the tool body that is pivoted from a first position to a second position to operate the actuating means.

4. The hand held and actuated combination piercing and riveting tool according to claim 1, wherein;

the hand actuated actuating means includes a handle pivotally mounted on the tool body that is pivoted from a first position to a second position to operate the actuating means.

5. The combination piercing and riveting tool according to claim 1, wherein:

the means for preventing relative movement between the second deforming surface of the mandrel head and the second end of the rivet body while a workpiece is being pierced to prevent the second deforming surface of the mandrel head from prematurely deforming the second end of the rivet body of the rivet assembly while a workpiece is being pierced is a mandrel shank end support means for supporting the free end of the mandrel shank of a rivet assembly loaded into the tool when the pointed piercing surface of the mandrel head of the rivet assembly is piercing a workpiece; and the hand actuated actuating means includes means for moving the mandrel shank end support means out of engagement with the free end of the mandrel shank of a rivet assembly loaded into the tool subsequent to passing the mandrel head of a rivet assembly loaded into the tool completely through a workpiece.

6. A hand held and actuated combination piercing and riveting tool in combination with a rivet assembly loaded into the tool for securing together workpieces including workpieces of suspended ceiling grid systems, comprising:

a rivet assembly comprising a rivet body and a mandrel with an elongated mandrel shank loaded into the hand held and actuated combination piercing and riveting tool; the rivet body being tubular with an annular flange at a first end and a second end to be deformed and set by the mandrel to secure the rivet body to a workpiece; the mandrel having a mandrel head with an outwardly directed pointed piercing surface for piercing a workpiece to which the rivet is to be secured and a deforming surface for deforming and setting the second end of the rivet body; the surface of the mandrel head for deforming and setting the second end of the rivet body engaging the second end of the rivet body; the elongated mandrel shank having a first end that is integral with and extends axially from the mandrel head and a second free end; the mandrel shank slidably passing from the mandrel head through the rivet body and beyond the first end of the rivet body to be gripped and pulled to effect a deformation and setting of the second end of the rivet body by the deforming surface of the mandrel head to secure the rivet body to a workpiece; and the mandrel shank having a weakened portion for separating the mandrel head from the mandrel shank after the second end of the rivet body is deformed and set by the deforming surface of the mandrel head; and the hand held and actuated piercing and riveting tool comprising:

a tool body;

the tool body having an anvil surface supporting the annular flange at the first end of the rivet body of the rivet assembly; the anvil surface having an opening therein; the elongated mandrel shank of the rivet assembly passing through the opening in the anvil surface and into a reciprocating mandrel shank puller means that is housed within the tool body for gripping and pulling the elongated mandrel shank of the rivet assembly to deform and set the second end of the rivet body of the rivet assembly with the deforming surface of the mandrel head of the rivet assembly; the tool body housing having means for preventing relative movement between the deforming surface of the mandrel head and the second end of the rivet body while a workpiece is being pierced to prevent the deforming surface of the mandrel head from prematurely deforming the second end of the rivet body of the rivet assembly while a workpiece is being pierced;

the tool body having a backing plate opposing and spaced from the anvil surface of the tool body; reciprocative mounting means mounting the backing plate on the tool body so that the backing plate can be moved toward the anvil surface of the tool body from a first position to a second position, to clamp a workpiece between the backing plate and the anvil surface of the tool body and to pierce the workpiece with the pointed piercing surface of the mandrel head of the rivet assembly and pass the second end of the rivet body and the mandrel head of the rivet assembly completely through the workpiece by forcing the workpiece down over the pointed piercing surface of the mandrel head until the workpiece comes in contact with the annular flange of the rivet body, and away from the second position and the anvil surface of the tool body back to the first position to release a workpiece previously clamped between the backing plate and the anvil surface of the tool body; and hand actuated actuating means for moving the backing plate from the first position to the second position to clamp a workpiece between the backing plate and the anvil surface of the tool body and pierce the workpiece with the pointed piercing surface of the mandrel head of the rivet assembly and pass the second end of the rivet body and the mandrel head of the rivet assembly completely through a workpiece, and for subsequently moving the shank puller to grip and pull the elongated mandrel shank of the rivet assembly to deform and set the second end of the rivet body of the rivet assembly with the deforming surface mandrel head of the rivet assembly, and moving the backing plate from the second position back to the first position.

7. The hand held and actuated combination piercing and riveting tool according to claim 6, wherein:

the backing plate has an opening means therein for loading rivet assemblies into the tool and for receiving the pointed end of the mandrel head of a rivet assembly that has been passed through a workpiece.

8. The hand held and actuated combination piercing and riveting tool according to claim 6, wherein:

the hand actuated actuating means includes a handle pivotally mounted on the tool body that is pivoted from a first position to a second position to operate the actuating means.

9. The combination piercing and riveting tool according to claim 6, wherein:

the means for preventing relative movement between the second deforming surface of the mandrel head and the second end of the rivet body while a workpiece is being pierced to prevent the second deforming surface of the mandrel head from prematurely deforming the second end of the rivet body of the rivet assembly while a workpiece is being pierced is a mandrel shank end support means supporting the free end of the mandrel shank of the rivet assembly and means for limiting lateral deflection of the mandrel shank when the pointed piercing surface of the mandrel head of the rivet assembly is piercing a workpiece; and the hand actuated actuating means includes means for moving the mandrel shank end support means out of engagement with the free end of the mandrel shank of a rivet assembly loaded into the tool subsequent to passing the mandrel head of a rivet assembly loaded into the tool completely through a workpiece.

* * * * *